US009896263B2

(12) United States Patent
Leong

(10) Patent No.: US 9,896,263 B2
(45) Date of Patent: Feb. 20, 2018

(54) COLLAPSIBLE CONTAINERS

(71) Applicant: Treck Pty Ltd., Queensland (AU)

(72) Inventor: Weng Yew Leong, Tambun Indah (MY)

(73) Assignee: Treck Pty Ltd, Maroochydore, Queensland (AU)

( * ) Notice: Subject to any disclaimer, the term of this patent is extended or adjusted under 35 U.S.C. 154(b) by 206 days.

(21) Appl. No.: 14/584,792

(22) Filed: Dec. 29, 2014

(65) Prior Publication Data

US 2015/0108120 A1 Apr. 23, 2015

Related U.S. Application Data

(63) Continuation of application No. 13/143,339, filed as application No. PCT/AU2009/001704 on Dec. 24, 2009, now abandoned.

(30) Foreign Application Priority Data

Jan. 5, 2009 (AU) ..... 2009900025

(51) Int. Cl.

| | |
|---|---|
| ***B65D 6/18*** | (2006.01) |
| ***B65D 88/52*** | (2006.01) |
| ***B65D 90/00*** | (2006.01) |
| ***E05B 83/02*** | (2014.01) |

(52) U.S. Cl.

CPC ..... *B65D 88/524* (2013.01); *B65D 90/0013* (2013.01); *B65D 90/0033* (2013.01); *E05B 83/02* (2013.01)

(58) Field of Classification Search

CPC ..... B65D 90/0086

USPC ..... 220/1.5, 9.2, 9.3, 666, 4.28, 4.29, 6, 7; 206/600

See application file for complete search history.

(56) References Cited

U.S. PATENT DOCUMENTS

| | | | |
|---|---|---|---|
| 3,570,698 | A | 3/1971 | Dougherty |
| 6,401,953 | B2 | 6/2002 | Kofod |
| 6,691,885 | B2 | 2/2004 | Brown |
| 2008/0135545 | A1 | 6/2008 | Sadkin et al. |

FOREIGN PATENT DOCUMENTS

| | | | |
|---|---|---|---|
| EP | 1136389 | A2 | 9/2001 |
| WO | 2006/024104 | A1 | 3/2006 |

*Primary Examiner* — J. Gregory Pickett

*Assistant Examiner* — Allan Stevens

(74) *Attorney, Agent, or Firm* — Schwabe Williamson & Wyatt, PC

(57) ABSTRACT

A collapsible shipping container has a corner post located at each corner of a base frame. A respective stile of an end cover frame, which may support at least one door, is pivotally mounted on the base frame adjacent each corner post. Respective lifting members on each corner post and stile have curved abutment faces which engage when the stile is in the erected position, and a latch member releasably locks the stile in the erected position.

The or each end cover frame may be provided with a spring—or winch system to assist in moving the end cover frame to the erected position.

10 Claims, 16 Drawing Sheets

Detail 1

Detail 2

Detail 3

COLLAPSIBLE CONTAINERS

CROSS REFERENCE TO RELATED APPLICATIONS

The present application is a continuation of U.S. Ser. No. 13/143,339, filed 23 Feb. 2012 entitled "Collapsible Containers," which is a national phase entry under 35 U.S.C. § 371 of International Patent Application No. PCT/AU2009/001704, filed 24 Dec. 2009, entitled "Collapsible Containers," which designates the United States of America, and which claims priority to Australian Patent Application No. 2009900025, filed 5 Jan. 2009, the entire contents and disclosures of which are hereby incorporated by reference in their entireties.

FIELD OF THE INVENTION

THIS INVENTION relates to collapsible containers.

The invention particularly relates, but is not limited to, containers for holding items therein, and which are collapsible (for storage and/or transport) when empty.

PRIOR ART

Containerisation, including the development and standardization of freight containers and of complementary specialized container-handling equipment, was a quantum leap in the field of materials handling.

The containers are used to hold items, both while in storage and while being transported between destinations by vehicles including trucks, trains, aircraft, ships, or other transport vehicles.

The costs of storage and transportation of the goods in containers are based on the respective volumes occupied by the containers; and so the costs are the same even if the containers are empty or partially-filled to capacity.

In many instances, the containers are only used once, eg., when used to transport goods to destinations which have little, if any, goods to be transported in return, or to other destinations. With a manufacturing cost of approximately USD 4000.00, any containers which are dumped and not re-used reflect of waste of manufacturing resources and money.

When empty containers are returned to their original destinations, or forwarded to other destinations, the transportation costs are the same as if the containers are full; and the operations of many ships or other transport vehicles are effectively wasted as they are transporting no more than big boxes of air.

While the empty containers are awaiting re-use, they typically occupy valuable storage space eg. on wharves, in railway yards, or at remote storage sites; and typically incur additional transportation costs to and from the storage sites.

To reduce storage and/or transportation costs for the empty containers, it is desirable to have containers that can be collapsed during storage and in transport. Collapsible containers have previously been proposed; and examples are disclosed in (i) International Application PCT/AU89/00354 (International Publication No. WO 90/02084=U.S. Pat. No. 5,190,179) (Richter et al) and (ii) International Application PCT/AU2005/001333 (International Publication No. WO 2006/024104) (Container Technology Pty Ltd et al)). (The contents of those respective disclosures are included in the present disclosure by way of reference.)

However, the prior art collapsible containers, including those disclosed in (i) WO 90/02084 and (ii) WO 2006/024104 do not meet the stringent container standards set by the transportation authorities and international insurance bodies around the world. These standards require the containers pass various structural strength tests, such as shock tests in relation to dropping from a height above floor level, tipping, rolling, stacking, racking, etc. When erected, the standards set minimum compressive loads which can be sustained when the containers are stacked, or tensile loads when the containers are being lifted; and the container standards also set minimum compressive and tensile loads for the collapsible containers, when collapsed, for storage or transit. The containers must at least meet, and more preferably exceed, the minimum standards, whether full, empty or partially-filled.

The standards also require the containers to be spray- or water-proof to protect the goods stored therein (and to minimize structural failure or other damage as a result of internal corrosion).

None of the known collapsible containers pass all these tests.

In addition, the manufacturing costs of any collapsible containers must be such that any additional manufacturing costs over those of conventional (rigid) containers must be more than offset during the expected life cycle of the collapsible containers, due to savings from reduced storage and/or transport costs when collapsed.

SUMMARY OF THE PRESENT INVENTION

It is an object of the present invention to alleviate, or to at least reduce, one or more of the disadvantages of the known collapsible containers.

It is a preferred object of the present invention to provide a collapsible container which is stable and meets the container standards when erected (and up to fully loaded) and/or when collapsed.

It is a further preferred object to provide a collapsible container which can be collapsed to occupy a volume no greater than 50% of the volume of the container when erected.

It is a still further preferred object to provide a collapsible container when can be handled by conventional container handling equipment when collapsed.

It is a still further preferred object to provide a collapsible container where adjacent components can be securely locked together when the container is erected, but allow easy release when the container is to be collapsed.

Other preferred objects of the present invention will become apparent from the following description.

Hereinafter throughout the specification, the term "a collapsible container as hereinbefore defined" will mean "a collapsible container of the type including: a base structure; a top structure; opposed side covers arranged between the base structure and top structure, each said side cover having a lower section frame pivotally connected to the base structure and a top section frame pivotally connected to the top structure; a central hinge arrangement configured so that the top section frame is pivotally movable relative to the lower section frame, whereby the side covers are selectively positionable between an erected position in which the top structure is remote from the base structure, and a collapsed position in which the top structure is at or adjacent to the base structure; the container when erected defining an interior space between the base structure and top structure; and end covers at opposed ends of the container, arranged to be pivotally movable between an upright position for covering respective ends of the container, and a lowered position for allowing the side covers to be moved to the collapsed position".

In one aspect, the present invention resides in base frame/end cover engagement assembly, for a collapsible container as hereinbefore defined, the assembly including:

a corner post located at a corner of the base frame and extending upwardly therefrom;

a lower lifting restraint extending laterally from the corner post, towards the interior space, and spaced above the base frame, the lower lifting restraint having, at a distal end, a downwardly-directed concave abutment face;

a stile of an end cover frame pivotally mounted on the base frame adjacent the corner post;

a lower lifting restraint block on the stile, the lower lifting restraint block having an upwardly-directed convex abutment face complementary to the concave abutment face on the lower lifting restraint; and a latch member on the corner post, or the stile, operable to releasably engage a stop member on the stile, or corner post, to releasably lock the stile in a substantially vertical position when a respective end cover is in an erected position; so arranged that:

in the erected position, the respective abutment faces of the lower lifting restraint and of the lower lifting restraint block are engaged to increase the load strength of the collapsible container, in the vertical direction, when erected.

Preferably, the corner post is formed integrally with the (hollow) base corner casting, operable to receive the twist-locks of adjacent container(s).

The lower lifting restraint may extend, and be fixed, to a vertical side plate of the base frame extending along one side thereof.

The lower lifting restraint block may be mounted on a bottom rail or plate of the end cover frame & fixed to the adjacent stile; where the axis of the curvature of the convex abutment face is preferably co-axial with the pivotal mounting of the end cover frame on the base frame.

At least one end cover frame comprises a door frame operable to support at least one door to provide selective (preferably lockable) access to the interior space.

Preferably, spring attachment plate(s) extend from the end cover frame, below the pivotal connection, and are operably connected to one or more (preferably tension) springs (preferably) mounted (in respective cylinders or housings) on the base frame to assist the movement of the end cover frame to its erected position.

Alternatively, attachment plate(s) extend from the end cover frame, below the pivotal connection, and are operably connected to a winch system having an operating bar slidably mounted on parallel guides on the base frame, the operating bar being movable relative to the base frame by a screw-threaded connection with an operating shaft rotatably journalled in the base frame, selective rotation of the operating shaft by a handle being operable to move the end cover frame between the raised and lowered positions.

In a second aspect, the present invention resides in a frame for an end cover, for a collapsible container as hereinbefore defined, the frame including at least two stiles connected by a head rail and a bottom rail, respectively, wherein:

a respective corner block is provided at the junction of a stile and the head rail, the corner block having body with an elongate slot or groove operable to receive, and engage, a spigot extending from the adjacent end wall when the end cover frame and the side wall are both in their erected positions.

Preferably a latch plate on the stile is releasably engageable with the spigot to releasably lock the end cover frame to the side wall.

The end cover frame may comprise a door frame, having at least one door hingedly mounted thereto to enable selective access to the interior space.

In a third aspect, the present invention resides in a locking mechanism to releasably lock a frame of an end cover to a side wall, of a collapsible container as hereinbefore defined, the locking mechanism including:

a striker plate mounted on, and extending from, the side wall;

a backing plate mounted on a stile of the end cover frame;

a sliding plate, extending laterally from the backing plate and operable to intersect the striker plate, the sliding plate being mounted on the backing plate between a released position and an engaged position; and a safety flap operable to restrain the sliding plate in the engaged position;

the striker plate having an upwardly-directed slot and/or the sliding plate having a downwardly directed slot, so arranged that, when in the engaged position, the sliding plate engages the striker plate to releasably lock the end cover frame to the side wall.

In a fourth aspect, the present invention resides in a collapsible container, as hereinbefore defined, having the features of any one or more of the first to third aspects hereinbefore described.

Other aspects of the present invention will become apparent from the following description.

BRIEF DESCRIPTION OF THE DRAWINGS

To enable the invention to be fully understood, preferred embodiments will now be described with reference to the accompanying drawings, in which.

NB: Any notations, including dimensions, on the drawings, are not limiting to the scope of the present invention, and are as guidance and by way of example only.

DETAILED DESCRIPTION OF THE PREFERRED EMBODIMENTS

Referring to FIGS. 1 to 9, the collapsible containers 10 of the present invention have base assemblies, roof assemblies, side walls and end covers (including doors) generally of the nature of the prior art collapsible containers of International Publications (i) WO 90/02084 and (ii) WO 2006/024104 discussed above, except where the specific advantageous features of the collapsible containers 10 of the present invention are hereinafter described in detail, with reference to the accompanying drawings.

The selection of specific materials/dimensions for the components for the containers 10 will be subject to design criteria enabling the collapsible containers 10 to meet, and preferably exceed, the internationally accepted standards for containers, whether rigid or collapsible.

Figure 8:
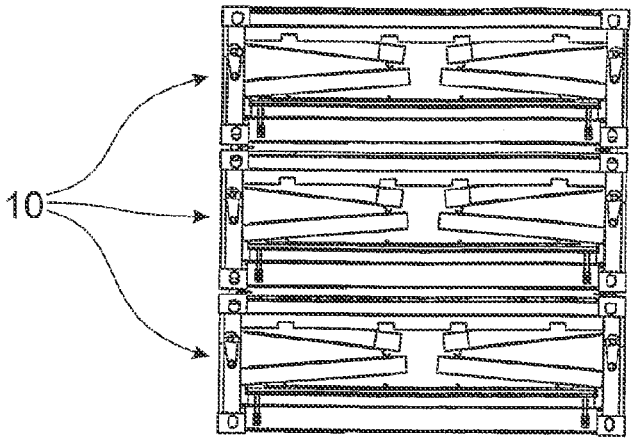
FIGS. 7, 8 and 9 are respective front isometric, end elevation and front elevation views of a plurality of the collapsible containers stacked together in their collapsed configurations.
Figure 7:
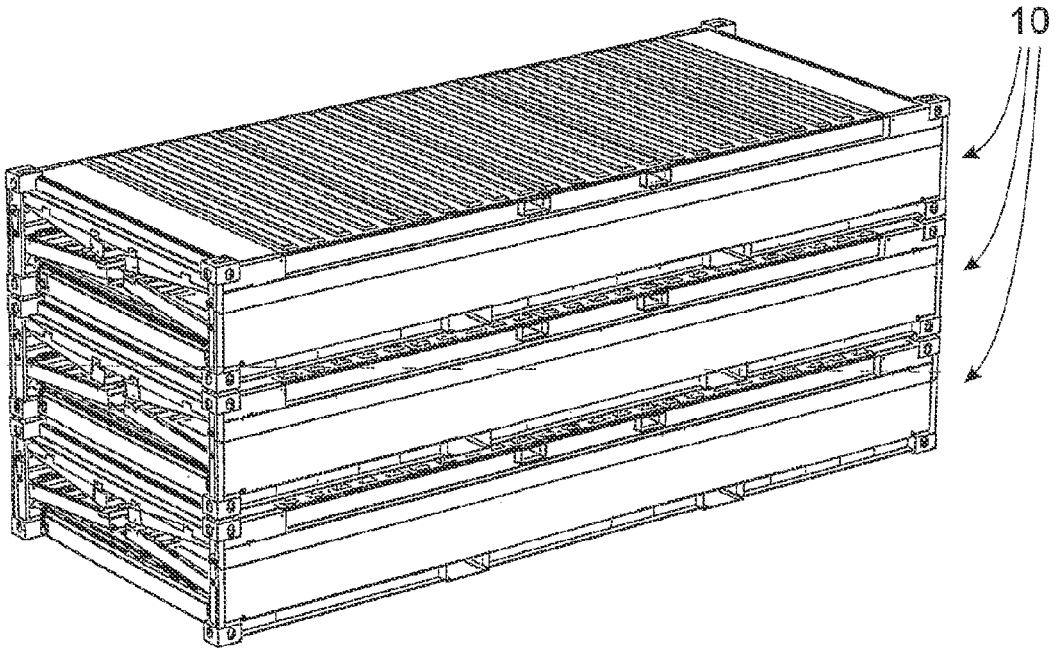
Figure 9:
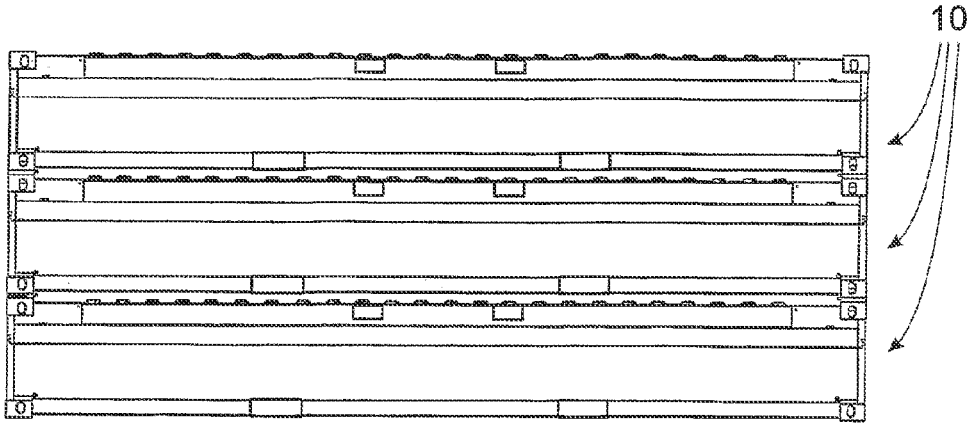

In FIGS. 7 to 9, three (3) collapsible containers 10 are shown stacked together, when collapsed, to occupy a volume of approximately one (1) of the collapsible containers 10 when erected. It is preferred that at least two (2) of the collapsible containers 10 will occupy the volume occupied by one (1) of the collapsible containers 10 when erected.

The containers 10 include a base assembly 20, a roof assembly 30, end covers 40 and side walls 50 to be hereinafter described in more detail.

Stacked collapsible containers 10, whether collapsed or erected, are releasably interconnected via the twist locks 90 (to be hereinafter described in more detail with reference to FIGS. 25 to 27) mountable on the roof assemblies 30 of the lowermost of the stacked collapsible containers 10.

Referring to FIGS. 10, 12 to 15, each base assembly 20 has a pair of side rails 21 (e.g., formed of RHS) interconnected by a plurality of cross beams 22 (eg., of C-section steel) and tubular end rails 23. A pair of tubular cross beams 24, which are open at their respective ends, are adapted to receive the lifting forks of a forklift or like materials handling machines.

Side plates 25 extend along each side of the base assembly 20, surmounting the side rails 21.

Cast lock housings 27, operable to receive the twist locks 90 from adjacent containers, or on materials- or transport-machines, are provided at each corner of the base assembly 20.

Figure 13:
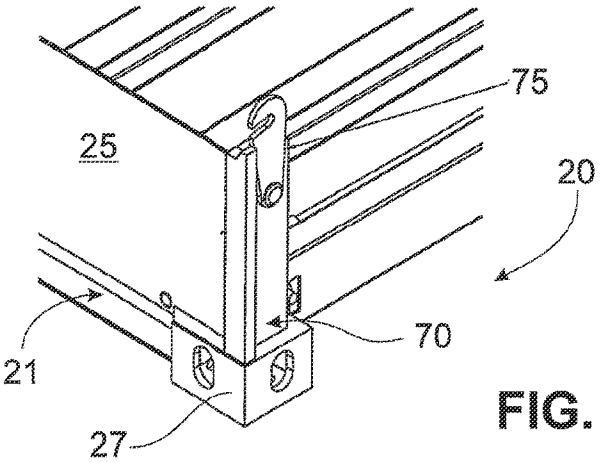
FIGS. 12 and 13 are respective internal and external isometric views of a corner of the base assembly of FIG. 10.
Figure 14:
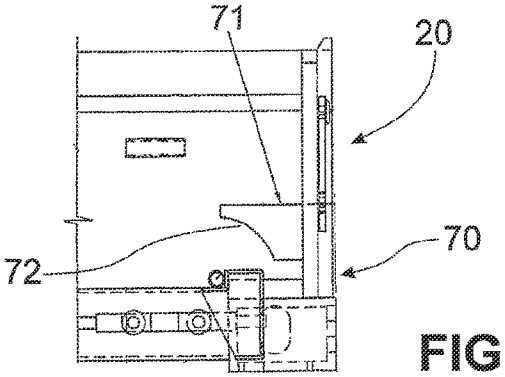
Figure 12:
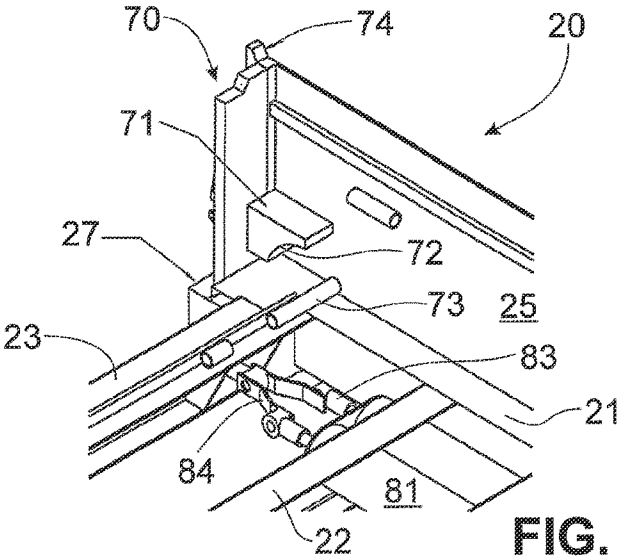

As shown more clearly in FIGS. 12 to 14, a corner post 70, of substantially L-shape, extends upwardly from a respective lock housing 27 and is fixed, e.g., welded, to the adjacent side rail 21 and side plate 25.

A lower lifting restraint 71 is provided on the inner face of the corner post 70, i.e. directed into the interior space of the collapsible container 10 and may also be fixed to the adjacent side plate 25 for increased strength.

The lower lifting restraint 71 has a downwardly-directed concave face 72, extending from the distal end of the lower lifting restraint 71, where the radius of curvature of the concave face 72 is measured from the centre line of a hinge tube 73, for the hinged mounting of an end cover 40, to be hereinafter described.

The other end of the corner post 70 has a base closure support finger 74 which assists in locating and supporting the adjacent end cover 40, when erected, or in the roof assembly 30 when the collapsible container 10 is collapsed.

A latch plate 75 is pivotally mounted on the external face of the corner post 70 and is operable to engage a headed stop, to be hereinafter described, on the end cover 40 when the latter is erected, or on a similar stop on the roof assembly 30 when the container 10 is collapsed.

Figure 16:
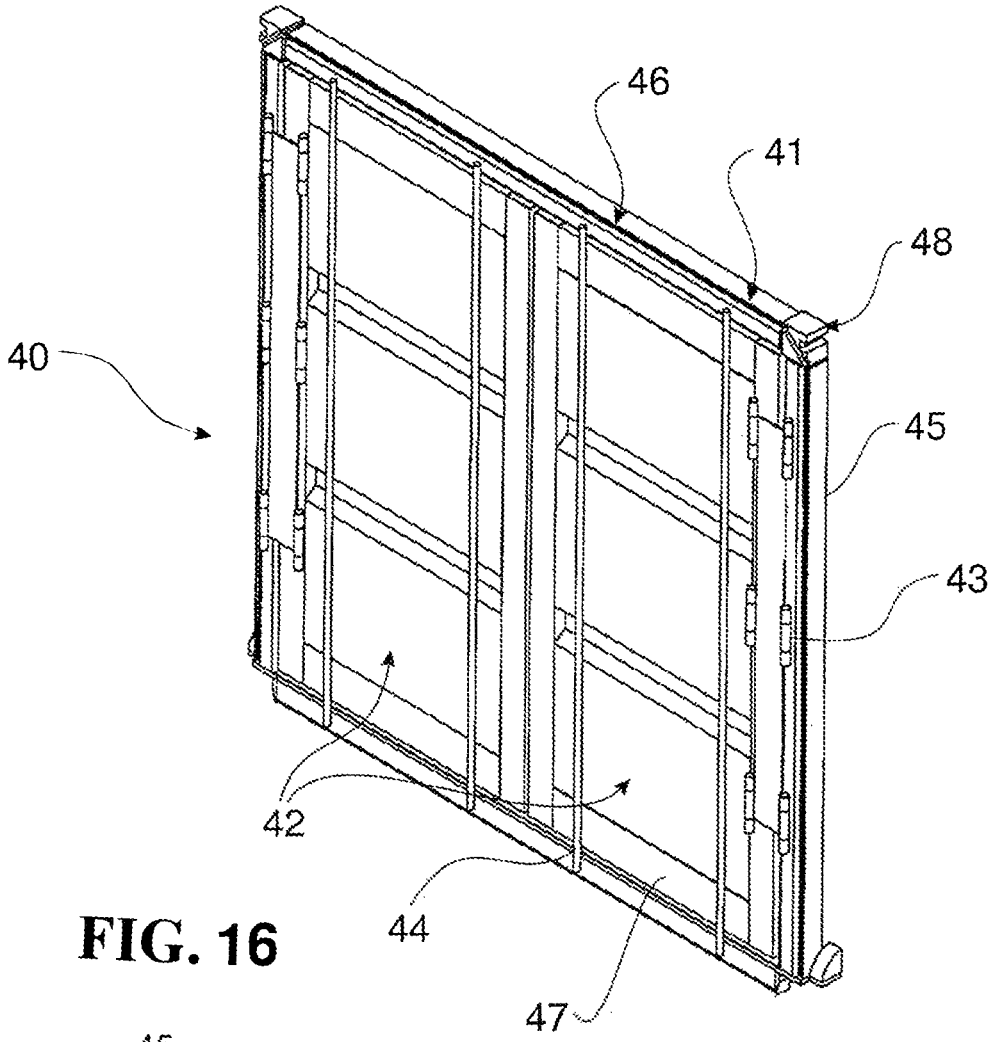
FIG. 16 is an isometric front view of an end cover, including a pair of hingedly-mounted doors, for the collapsible container.
Figure 17:
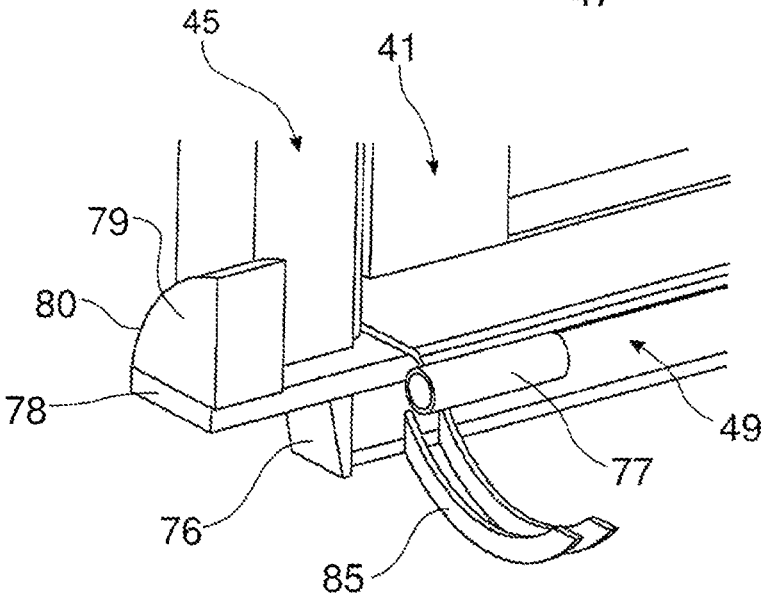
FIG. 17 is a schematic isometric view of one corner of the end cover of FIG. 16.
Figure 20:
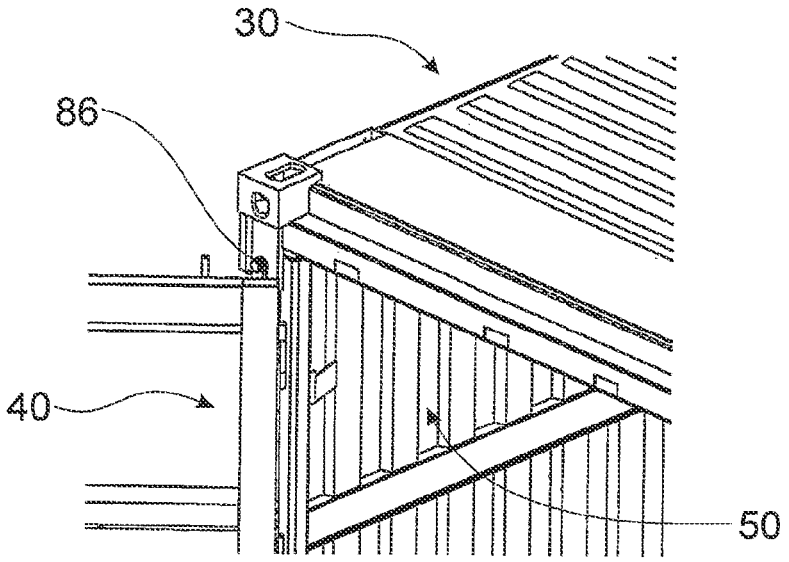
FIGS. 20 and 21 are similar views of a roof corner of the collapsible container.
Figure 18:
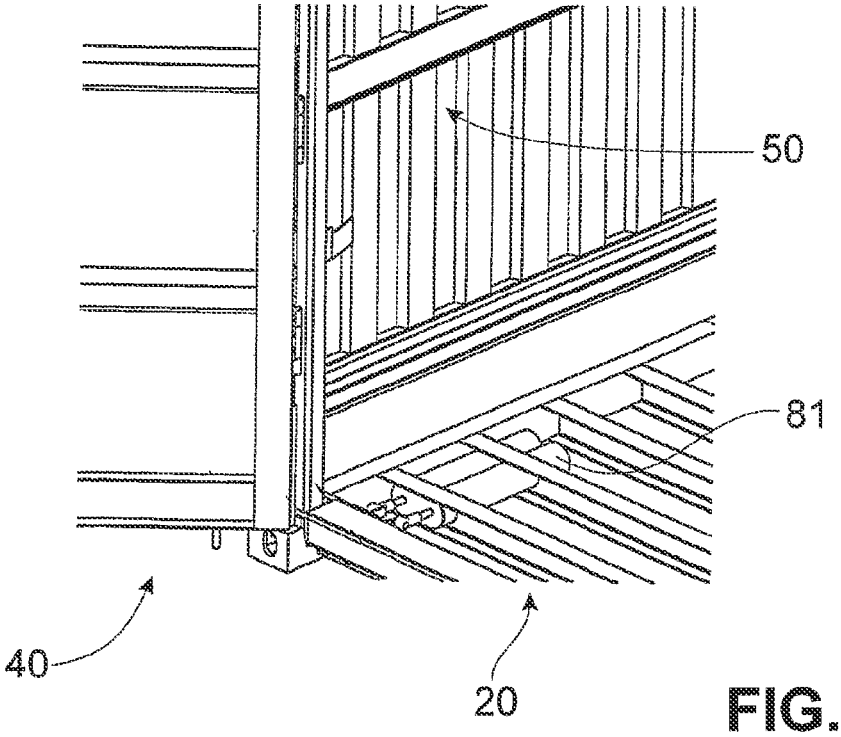
FIGS. 18 & 19 are respective isometric views of a base corner of the collapsible container viewed externally and internally.
Figure 21:
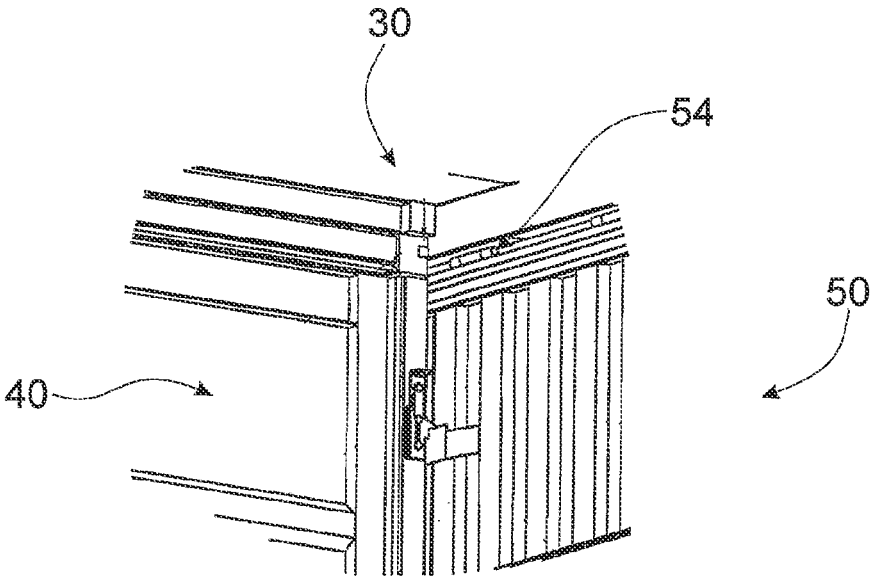
Figure 19:
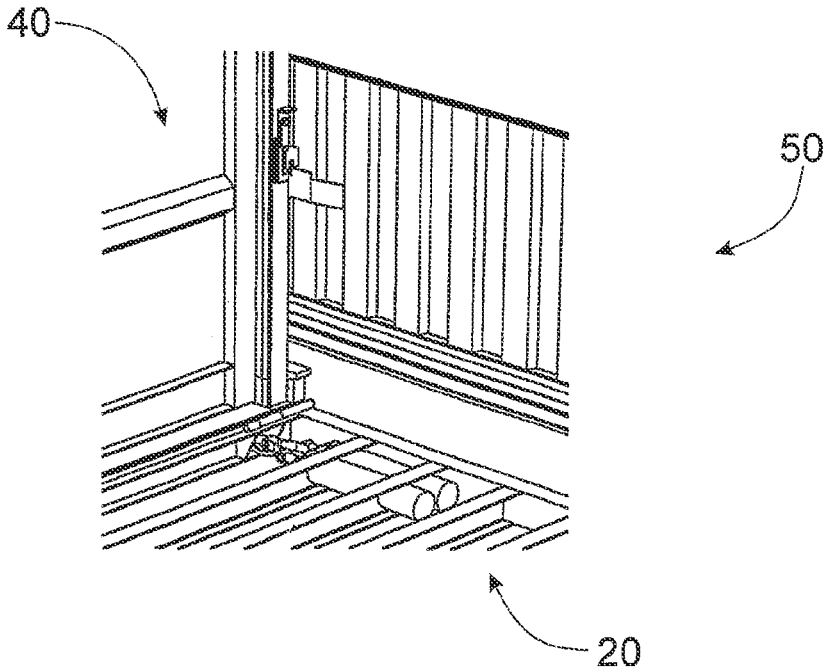

Referring to FIGS. 16 and 17, normally, one end cover 40 has a "solid infill" end panel, while the second end cover 40 has a door frame 41 hingedly mounting a pair of doors 42, mounted on hinges 43 and lockable by lock mechanisms 44 in the manner of existing containers.

Each door frame 41 has a pair of stiles 45 (which are vertical when the container is erected) interconnected by a head rail 46 and a bottom rail 47; while a corner block 48 is provided at the junction of the head rail with each stile).

The bottom rail 47 of the door frame 41 may be formed of steel aluminium plate, with a door frame step 49 extending downwardly from the outer side thereof, the latter terminated by a pair of end seal plates 76 adapted to lie adjacent the respective lock housings 27 when the door frame 41 is erected.

Respective hinge tubes 77 on the inner side of the bottom rail 47 are adapted to be aligned with the hinge tubes 73 on the respective end rails 23 of the base assembly 20 and to receive suitable hinge pins (not shown).

The bottom rail 47 extends past the respective stiles 45 and the upper face of each extension 78 is provided with a lower lifting restraint block 79 which has an upwardly directed convex face 80 complementary to the concave face 72 of the respective lower lifting restraint 71 on an adjacent corner post 70.

When the door frame 41 (or end cover frame) is moved to the erected position, the lower lifting restraint block 79 engages the lower lifting restraint 71 on the base assembly 20 to provide a releasable connection which provides both lateral stability, but more importantly, improved load transfer in the vertical direction when the container 10 is erected and being lifted.

While the respective concave and convex faces 72, 80 of the lower lifting restraint 71 and lower lifting restraint block 79, respectively, could be substituted by complementary "wedged" faces, the curved faces provide improved release and engagement between the components.

To assist in the raising and lowering of the end covers 40, a pair of tension springs (not shown) are provided in tubular spring housings 81 mounted in the cross beams 22 of the base assembly 20 and have piston rods 83 connected via suitable linkages 84 to door closure attachment plates 85 extending inwardly from the door frame step 49 (below the bottom rail) of the end covers 40.

When the end covers 40 are moved to the collapsed position, the door closure attachment plates 85 and linkages 84 pull the piston rods 83 to cause the tension springs to be tensioned. As the door covers are being raised, the tension springs compress towards their "neutral" position and thereby provide a force assisting in raising the end covers 40 to their erected positions.

Figure 11:
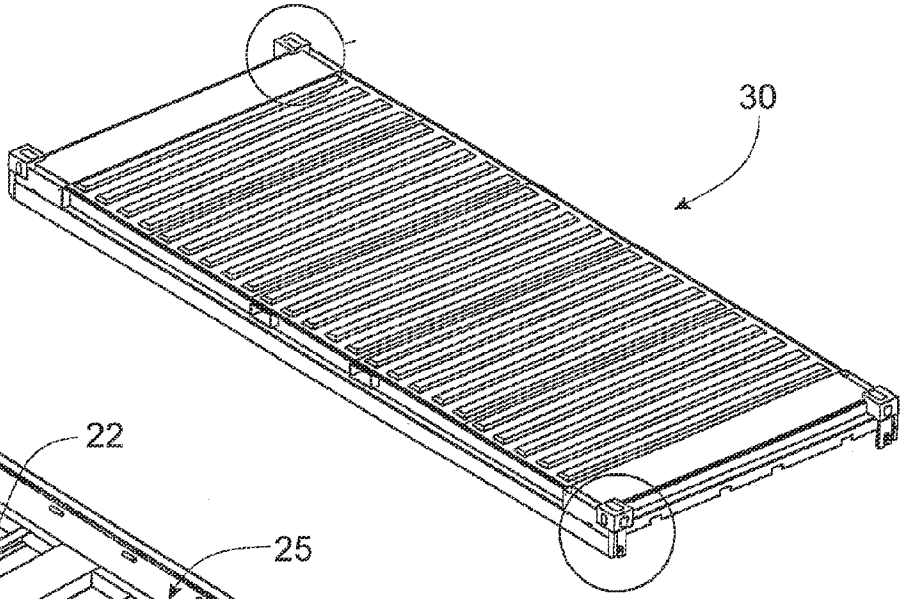
FIG. 11 is a similar view of the roof assembly for the collapsible container.
Figure 10:
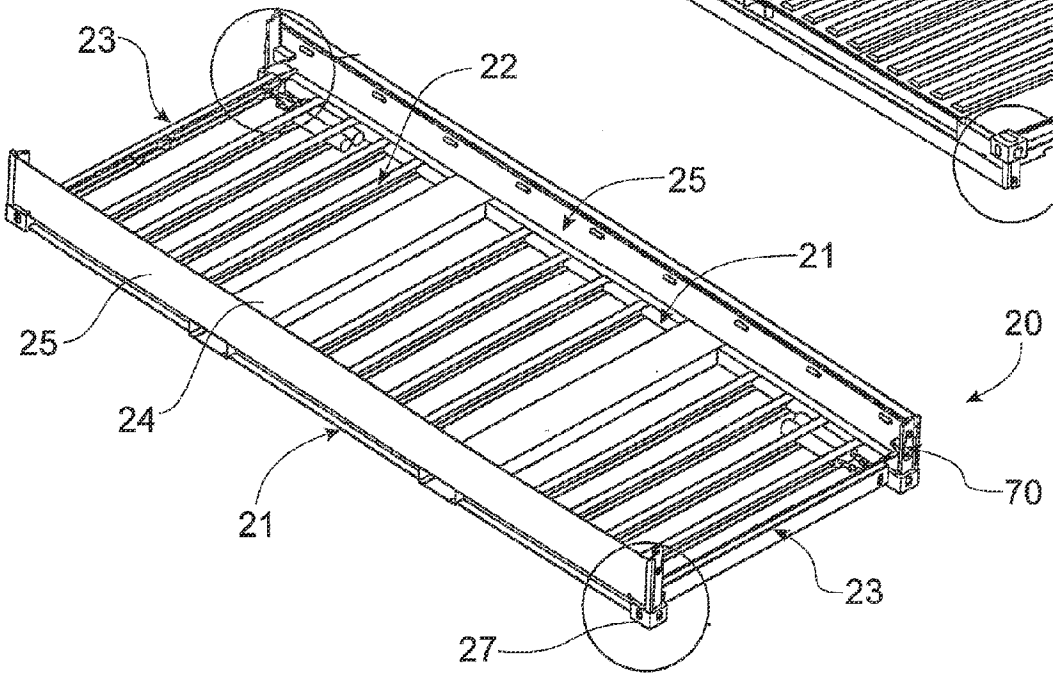
FIG. 10 is a front isometric view of the base assembly for the collapsible container.
Figure 15:
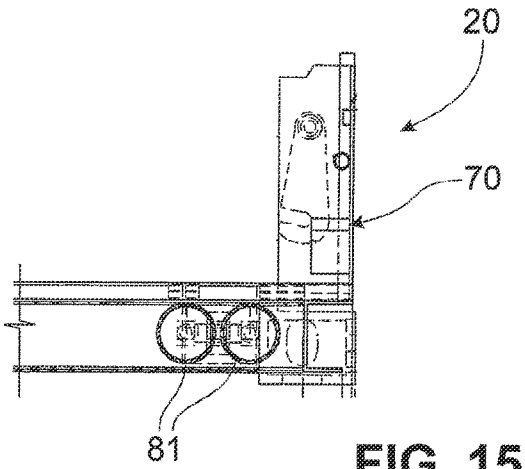
FIGS. 14 and 15 are respective sectional views of the corner of FIGS. 12 and 13.

FIG. 11 illustrates the roof assembly for the collapsible container; while FIGS. 20, 21, 24 and 25 illustrate the connection of the roof assembly 30 and the side walls 50 to the end covers 40.

The upper edges of the side walls 50 are hingedly connected to the roof assembly 30 by a plurality of spaced hinges to be hereinafter described.

A headed spigot 86 on the roof assembly 30 can either extend through an aligned hole in the corresponding stile 45 of the end cover 40, or through the respective corner block 48 of the end cover 40 and be releasably engaged by a closure latch plate 87 hingedly mounted on the stile 45 and prevented from accidental release by a hinged keeper 88 pivotally mounted on the spigot 86.

The corner blocks 48 at the upper corners of the end covers 40 provide strength and rigidity to the door frames 41 to assist and prevent lateral twisting of the container 10 when erected and to assist in providing effective transfer of vertical loads from the stiles 45 to the roof assembly 30.

Figure 25:
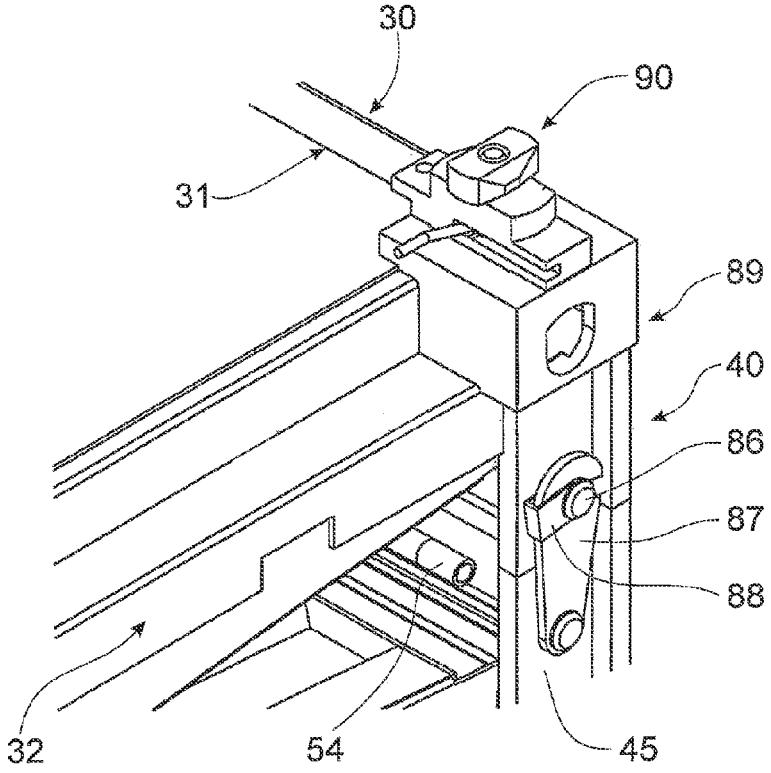
FIG. 25 is a similar view on an enlarged scale.
Figure 24:
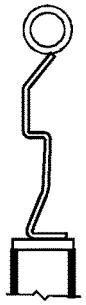
FIG. 24 is a front isometric external view of a roof corner of the collapsible container.
Figure 24:
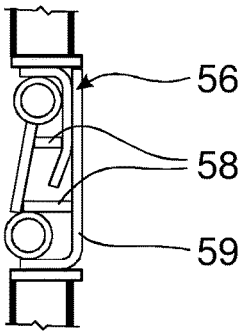
Figure 24:
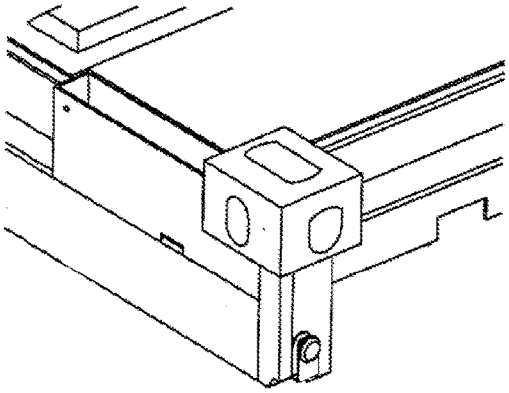
Figure 31:
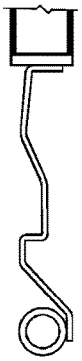
FIG. 31 is an enlarged end view of the details (1) to (3) on FIG. 30.

As particularly illustrated at FIGS. 24 and 25, a twist lock assembly 90 can be provided for releasable engagement with a roof corner lock casting 89 to enable releasable engagement with a container 10 stacked thereon.

The corner lock casting 89 provides a strong junction between the side and end rails 31, 32 of the roof assembly 30.

Figure 27:
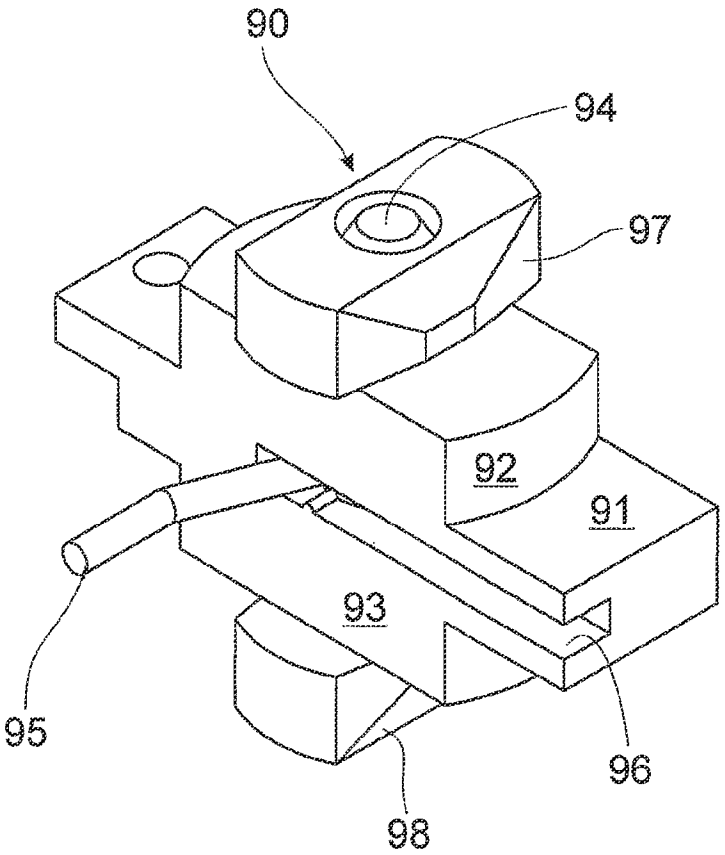
FIGS. 26 and 27 are respective front isometric views of a twist-lock assembly for the collapsible container, with the twist-locks in the released and locking positions.
Figure 26:
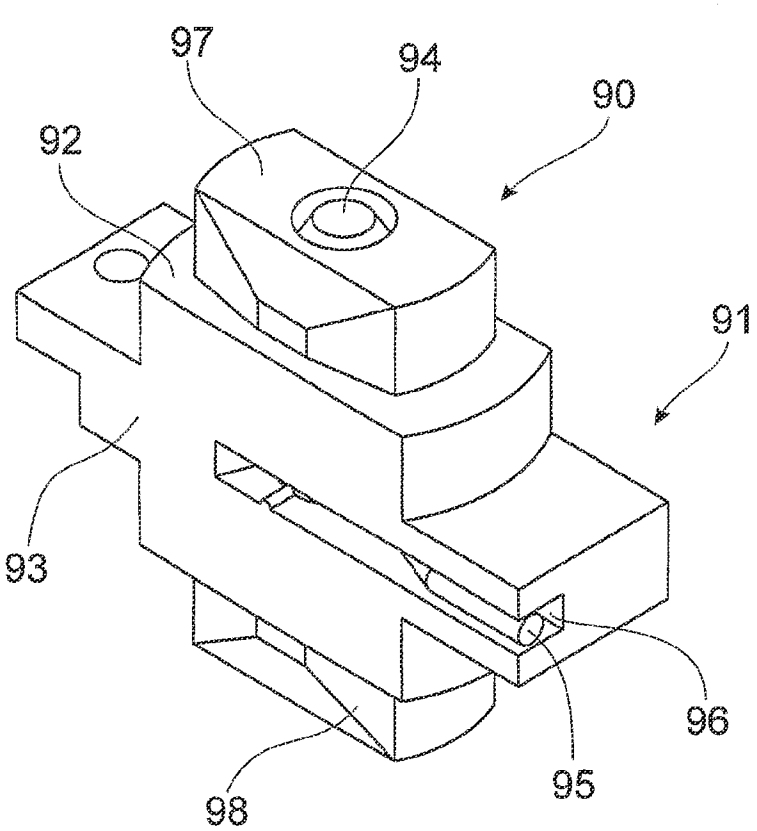

As shown in more detail in FIGS. 26 and 27, the twist lock assembly 90 has a body 91, eg., of cast steel or aluminium with upper and lower lugs 92, 93 arranged for engagement in complementary holes in the corner lock housings 27, 89 of the containers 10.

A shaft 94 is rotatably journalled in the body 91 and is selectively rotatable between an unlocked position, where the operating handle 95 is received within a slot 96 in the body, as shown in FIG. 26; and an operating position, where the handle 95 extends from the slot 96, as shown in FIG. 27.

Respective twist lock knobs 97, 98 are secured to the shaft 94 and are rotatable therewith for releasable engagement between adjacent containers.

Figure 30:
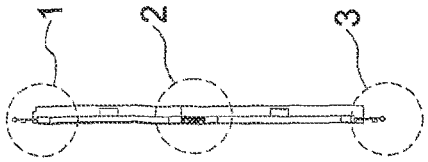
FIG. 30 is a sectional view on line "A" on FIG. 28.
Figure 31A:
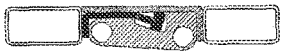
FIG. 31A is an enlarged isometric view of a hinge plate for the side wall.
Figure 28:
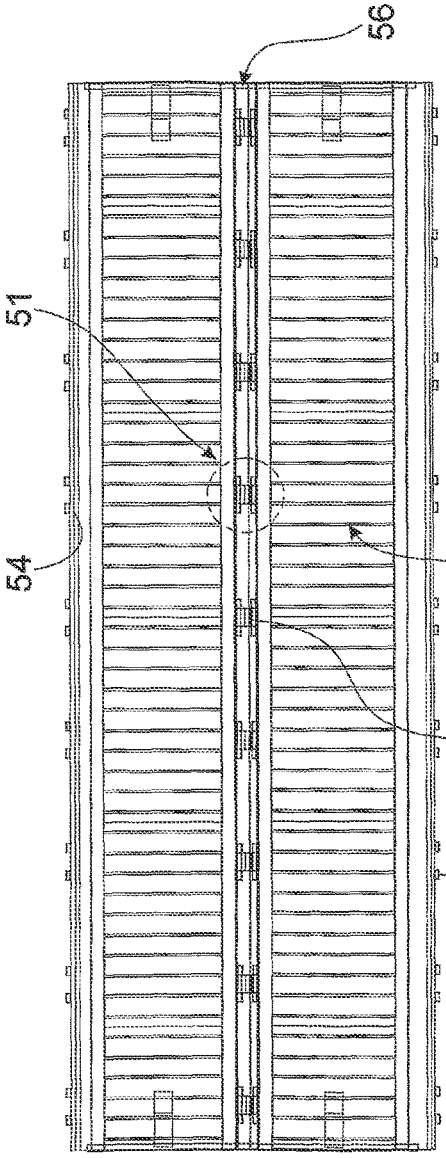
FIGS. 28 and 29 are respective front elevation and front isometric views of a side wall for the collapsible container.
Figure 29:
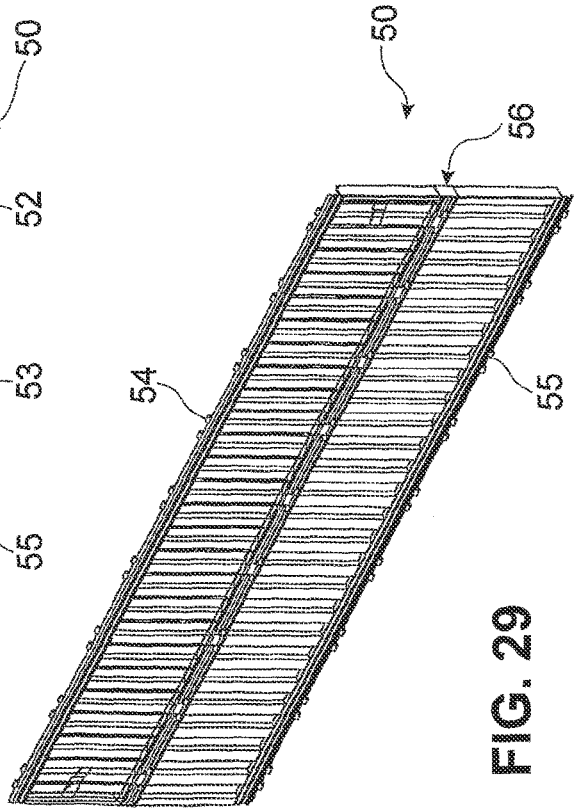
Figure 32:
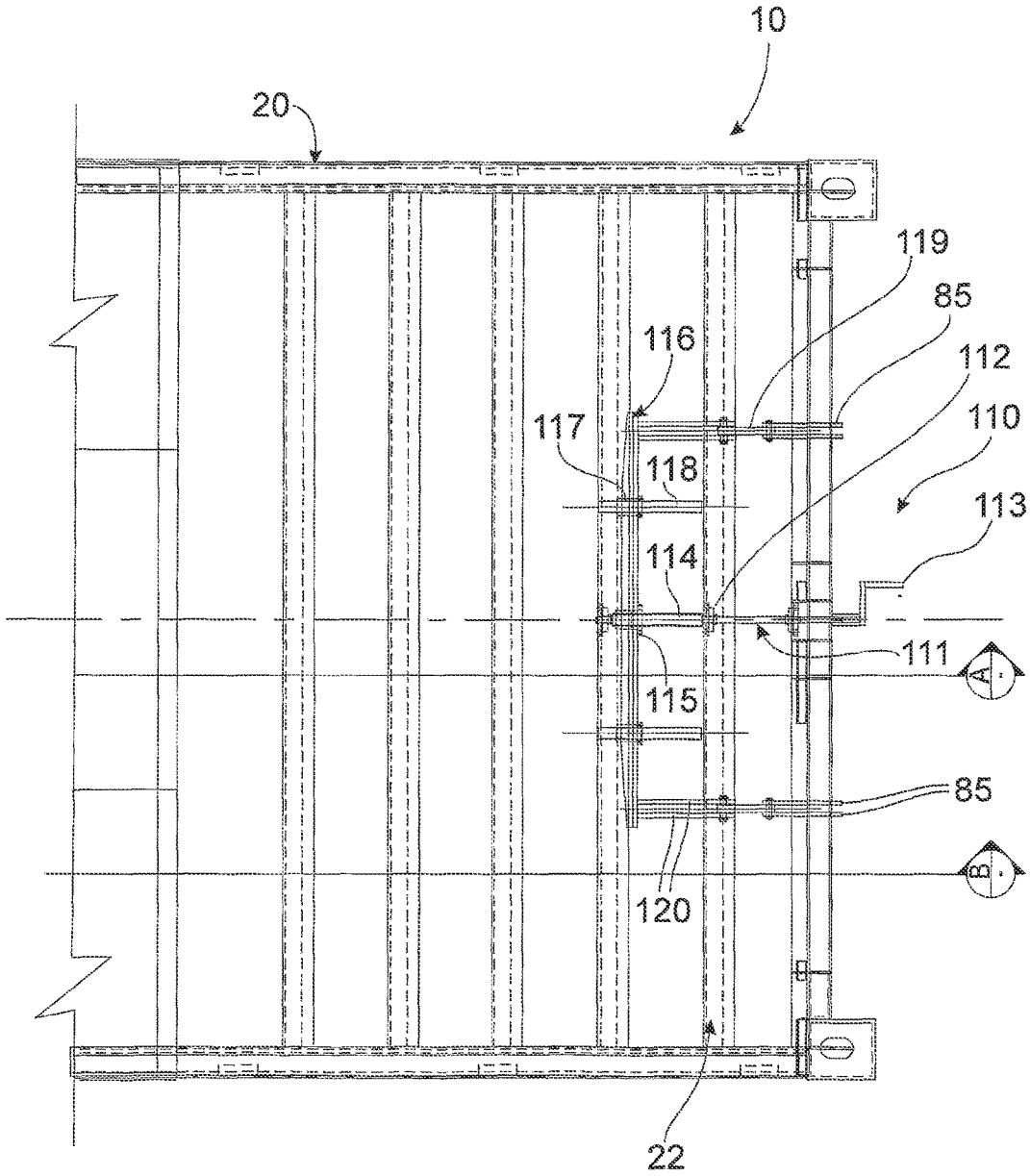
FIG. 32 is a top plan view of one end of the base frame illustrating a winch system for the door at that end.
Figure 34:
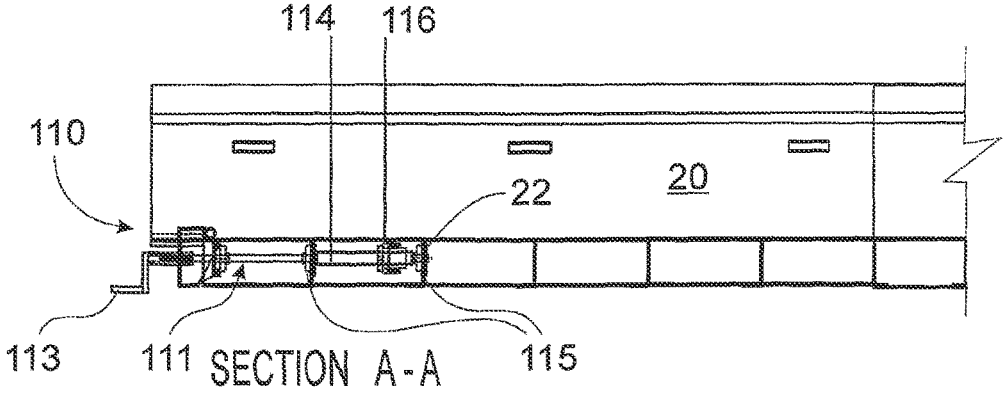
FIG. 34 is a side elevational view taken on line "A" on FIG. 32.
Figure 35:
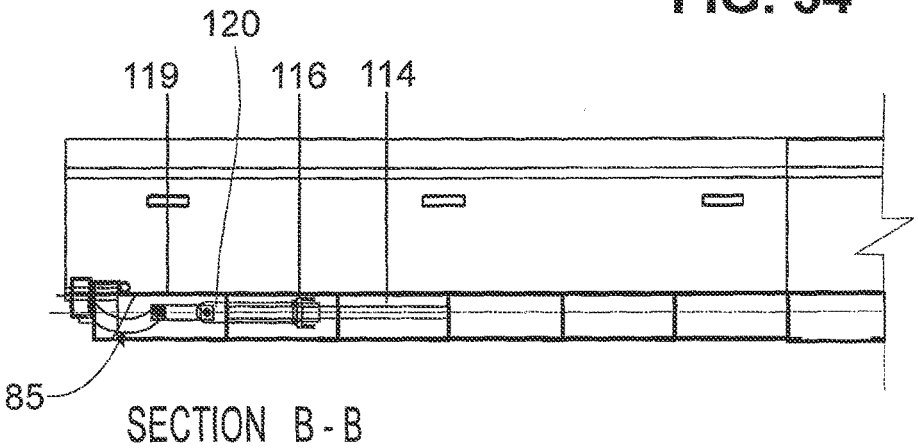
FIG. 35 is a similar view taken on line "B" on FIG. 32.
Figure 33:
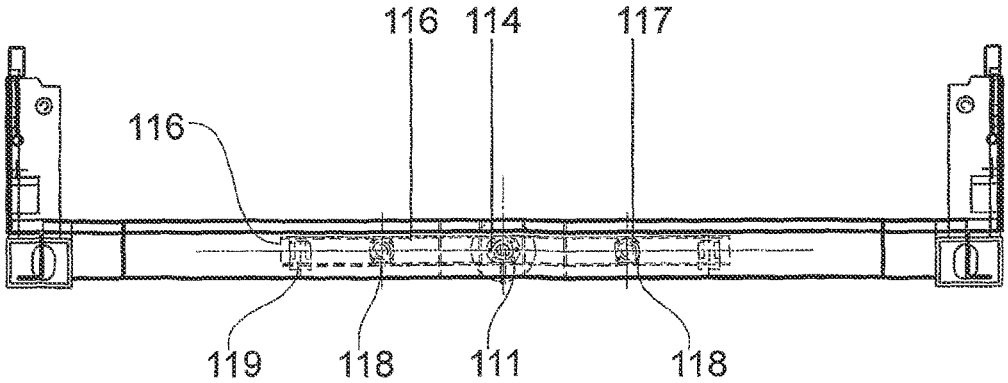
FIG. 33 is an end elevational view thereof.

As illustrated in FIGS. 28 to 30, each side wall assembly 50 has an upper wall portion 51 and a lower wall portion 52 interconnected by a plurality of cast double-hinge members 53 which are provided at spaced intervals to enable hinged interconnection between the upper and lower wall portions 51, 52.

Figure 2:
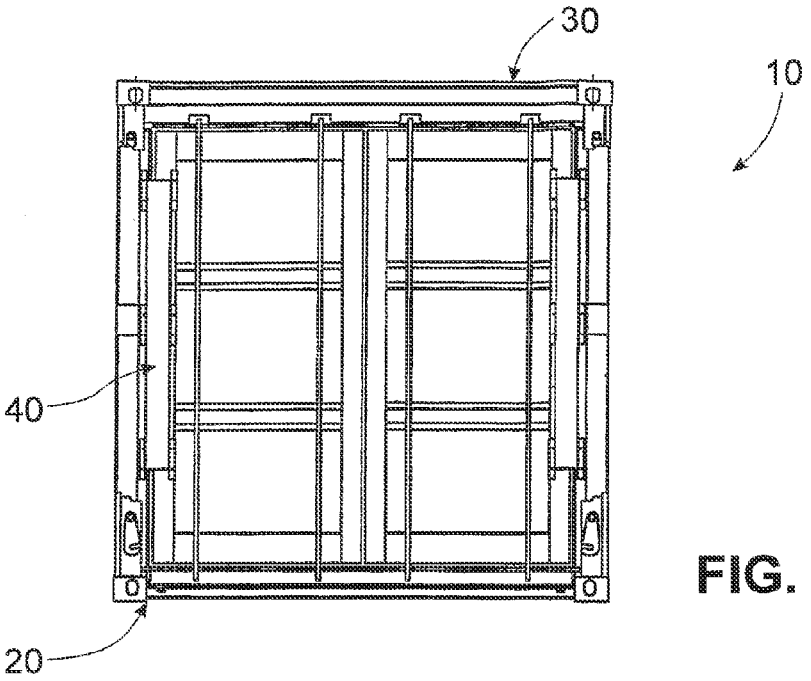
FIGS. 1 and 2 are respective front isometric and end elevation views of a collapsible container, in accordance with the present invention, in its erected configuration.
Figure 1:
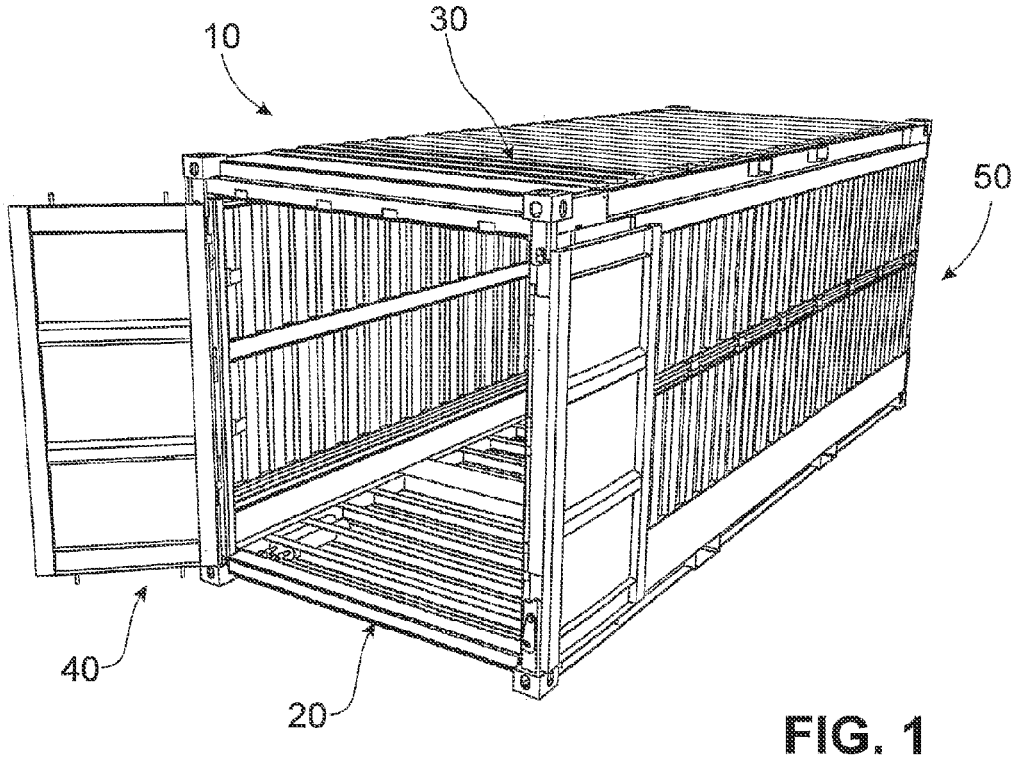
Figure 4:
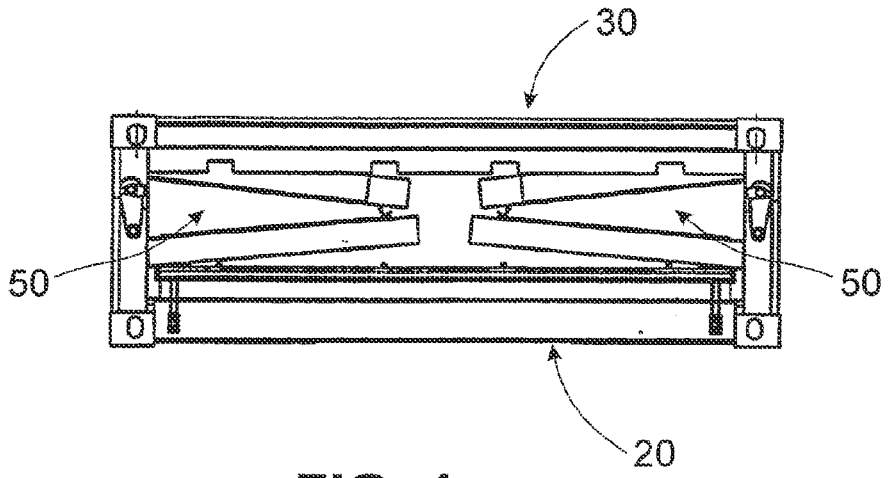
FIGS. 3, 4 and 5 are respective front isometric, end elevation and front elevation views of the collapsible container in its collapsed configuration.
Figure 3:
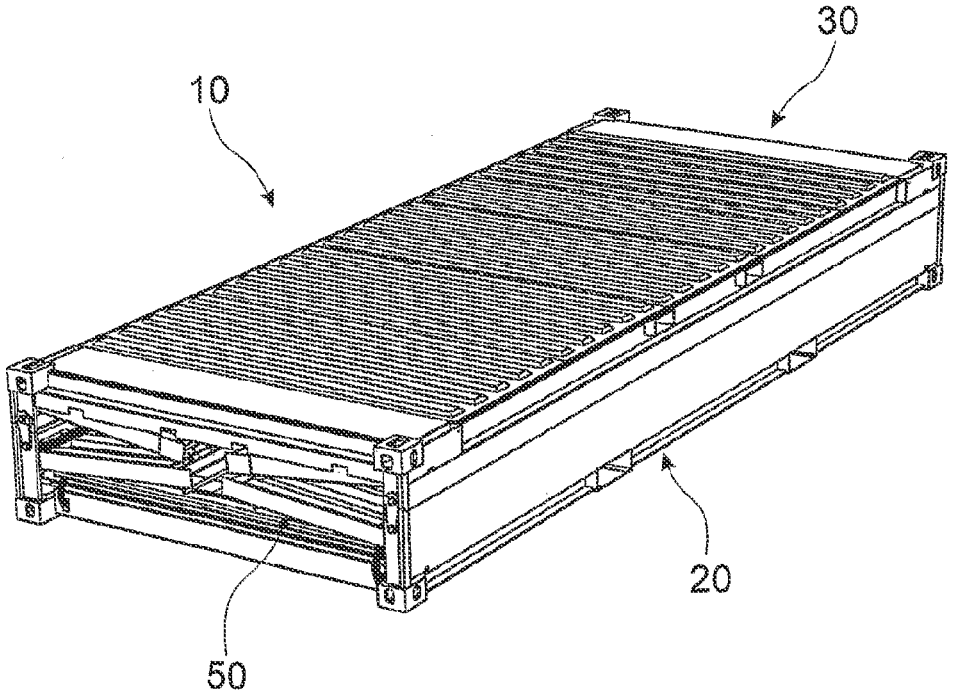
Figure 5:
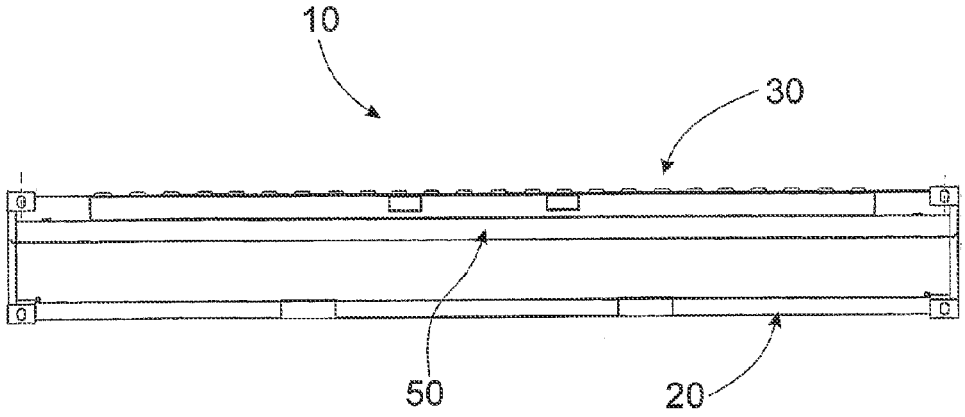
Figure 6:
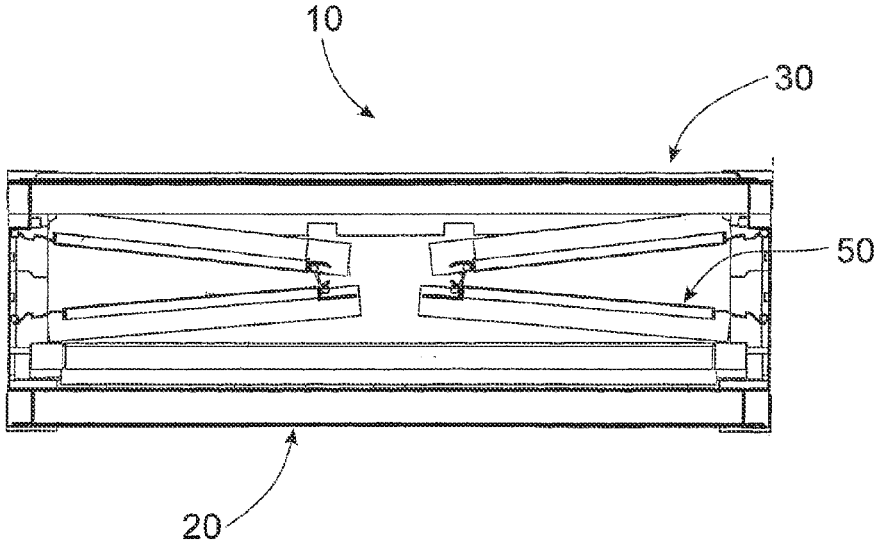
FIG. 6 is a sectional view on line A in FIG. 5.

The upper and lower wall portions 51, 52 are respectively hingedly connected to the roof assembly 30 and base assembly 20 by spaced hinges 54, 55; and as illustrated in FIGS. 4, 6 and 8, the central wall portion 56 may be moved inwardly to enable the roof assembly 30 to be moved towards the base assembly 20 to enable the container to be collapsed; or vice versa.

As illustrated, by way of example, the double-hinge members 53 may have flanges or extensions 58 operable to engage the wall 59 of the central wall portion 56 so that the upper and lower wall portions 51, 52 are maintained in vertical alignment when the container 10 is erected; and to oppose any deflection of the side walls 50 when load is applied thereto through the roof assembly 30.

Figure 23:
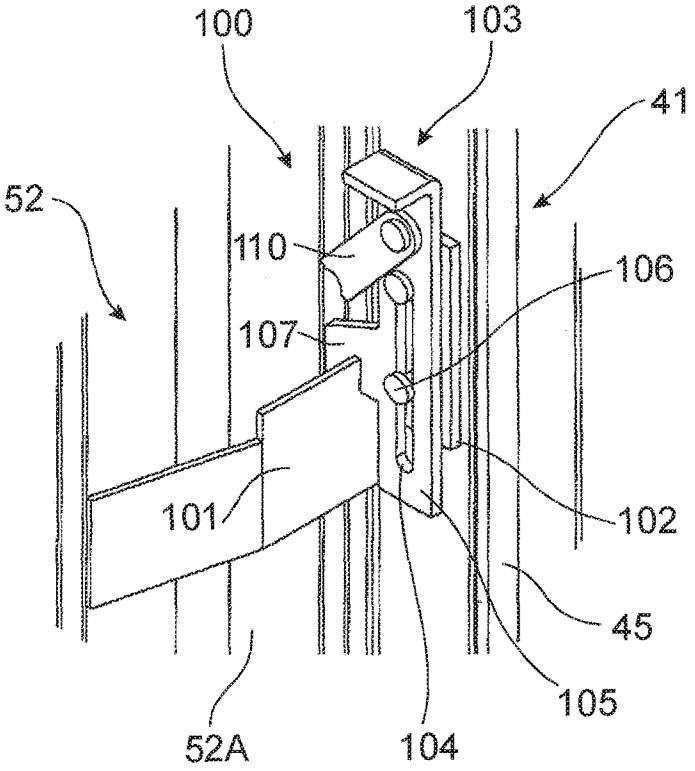
FIGS. 22 and 23 are respective front isometric views of a locking assembly, for the side walls, in the released and locked positions.
Figure 22:
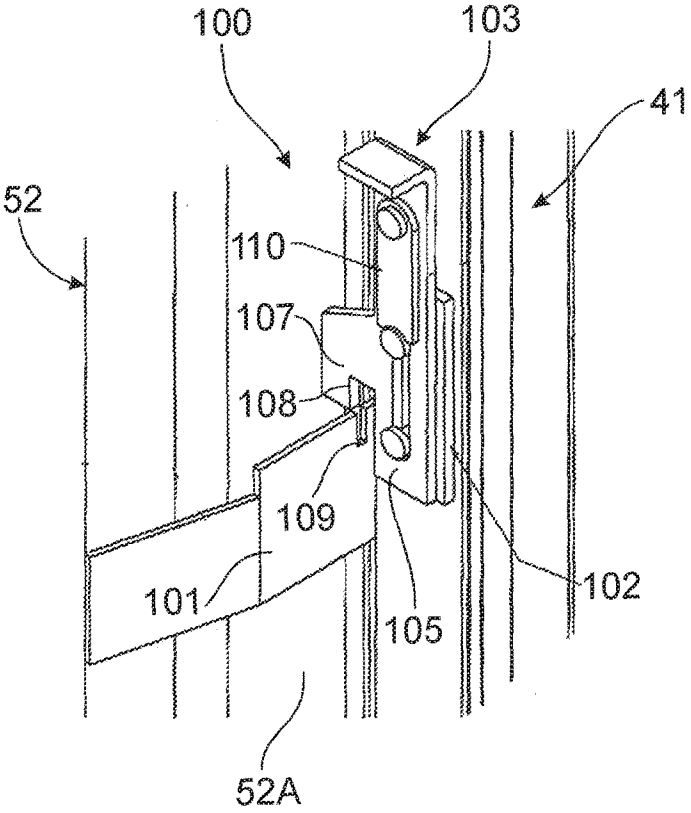

To further stabilize the side walls 50, a respective locking mechanism 100—see FIGS. 22 and 23, is provided to releasably lock the door frame 41 of an end cover 40 to the adjacent side wall 50.

NB: While the locking mechanism 100 is preferably provided between the end cover 40 and the lower side wall portion 52, respective locking mechanisms 100 could be provided between the end cover 40 and both the upper and lower side wall portions 51, 52.

The locking mechanism 100 has a striker plate 101 mounted on, and extending from, the side wall 50 lying parallel to and spaced a small distance from, the end frame member 52A of the lower side wall portion 52.

A backing plate 102 is mounted on the inner face of the adjacent stile 45 of the end cover 40 and slidably mounts a sliding plate 103, of substantially inverted L-shape in end view, where an elongate slot 104 in the body 105 of the sliding plate 103 receives a pair of support pins 106 extending from the backing plate 102.

The sliding plate 103 has a substantially L-shaped finger 107 extending laterally from the body 105 of the sliding plate 103 with a downwardly directed slot 108 which is aligned with a complementary upwardly directed slot 109 in the top face of the striker plate 101. A safety flap 110 is pivotally mounted on the sliding plate 103 and is movable between a first position where it engages the uppermost of the pins 106 in the backing plate 102 so that the finger 107 is released from engagement from the striker plate 101; and a second position disengaged from the pin 106, allowing the sliding plate 103 to be lowered so that the finger 107 releasably engages the striker plate 101.

The striker plate 101 and finger 107 together form an interlocking cruciform assembly which prevents movement in all three axes between the side wall portion 52 and the adjacent end cover 40. This, of course, prevents unwanted "bowing" of the side wall 50 when vertical loads are applied to the roof assembly 30 of the container 10 (and indeed also assists in load transfer between the side wall 50 and the end cover 40 when the container 10 is being lifted while erected—irrespective of whether or not the container has any contents).

FIGS. 32 to 35 illustrate a winch system 110 may be provided at one end, or both ends, of the base assembly 20 to raise/lower the end cover 40 when the container 10 is to be erected/collapsed, respectively.

The winch system 110 has an operating shaft 111 rotatably journalled in bearings (or bushes) 112 in cross beams 22 of the base assembly 20, and has a detachable (or foldable) handle 113 at its distal end. (A "universal joint" may interconnect the handle 113 to the operating shaft 111.)

The inner end of the operating shaft 111 has a screw-threaded portion 114 operably engaged by a travelling screw 115 on a transverse operating bar 116 which is guided by sliding bushes 117 engaged on parallel guides 118 interconnecting adjacent cross beams 22.

Operating links 119 are interposed between the door closure attachment plates 85, connected to the end covers 40 (as hereinbefore described), and respective pairs of operating plates 120 adjacent the respective ends of the operating bar 116.

Each full rotation of the operating shaft 111 moves the operating bar e.g. 10 mm, where total travel of e.g. 150 mm is required to fully raise or lower the end cover 40 connected thereto.

The skilled addressee will appreciate the raising of the end cover 40 may additionally be assisted by the tension springs also connected to the door closure attachment plates 85, as hereinbefore described.

Alternatively, the handle 113 may be substituted by releasable connection of the distal end of the operating shaft 111 to the output shaft of a portable "power-pack" (not shown), such as a hydraulic motor connected to a engine-driven pump, which is selectively operate to rotate the operating shaft 111 to raise or lower the end cover 40. The use of such a "power-pack" enables the containers 10 to be quickly and easily erected or collapsed, as required.

The collapsible container 10 of the present invention can be easily collapsed for storage or transport when empty; but equals or exceeds the international standards for shipping containers when erected; and any additional manufacturing cost can be quickly recovered by the reduced storage or transport costs when the containers are collapsed; and their re-use over many storage/transport cycles, rather than being dumped as a "use once only" item.

Various changes and modifications may be made to the embodiments described and illustrated without departing from the present invention.

The invention claimed is:

1. A base frame/end cover engagement assembly, for a collapsible container, the assembly including:

a corner post located at a corner of a base frame and extending upwardly therefrom;

a lower lifting restraint extending laterally from the corner post, towards an interior space, the lower lifting restraint having, at a distal end, a downwardly-directed concave abutment face;

a stile of an end cover frame pivotally mounted on the base frame adjacent the corner post;

a lower lifting restraint block on the stile, the lower lifting restraint block having an upwardly-directed convex abutment face complementary to the concave abutment face on the lower lifting restraint; and a latch member on the corner post, operable to releasably engage a stop member on the stile to releasably lock the stile in a substantially vertical position when a respective end cover is in an erected position; so arranged that:

in the erected position, the respective abutment faces of the lower lifting restraint and of the lower lifting restraint block are engaged to increase a load strength of the collapsible container, in a vertical direction, when erected; and the lower lifting restraint extends along, and is fixed to, a vertical side plate extending along a side of the base frame.

2. The assembly as claimed in claim 1, wherein:

the corner post is formed integrally with a base corner casting operable to receive one or more twist-locks of adjacent container(s).

3. The assembly as claimed in claim 1, wherein:

the lower lifting restraint block is mounted on a bottom rail or plate of the end cover frame and fixed to an adjacent stile;

where an axis of a curvature of the convex abutment face is substantially co-axial with the pivotally mounted end cover frame on the base frame.

4. The assembly as claimed in claim 1, wherein:

at least one end cover frame comprises a door frame operable to support at least one door to provide selective access to the interior space.

5. The assembly as claimed in claim 4, wherein:

at least one door closure attachment plate extends from the end cover frame, below a pivotal connection, and is operably connected to one or more springs mounted on the base frame to assist the movement of the end cover frame to its erected position.

6. The assembly as claimed in claim 4, wherein:

at least one door closure attachment plate extends from the end cover frame, below a pivotal connection, and is operably connected to a winch system having an operating bar slidably mounted on parallel guides on the base frame, the operating bar being movable relative to the base frame by a screw-threaded connection with an operating shaft rotatably journalled in the base frame, where selective rotation of the operating shaft by a handle is operable to move the end cover frame between a raised position and a lowered position.

7. A collapsible container having:

the assembly as claimed in claim 1.

8. The assembly as claimed in claim 4, wherein the door frame includes at least one door operable to provide lockable access to the interior space.

9. The assembly of claim 5, wherein the one or more springs are tension springs.

10. The assembly of claim 9, wherein the one or more tension springs are in respective cylinders or housings.

* * * * *